US010890166B2

(12) United States Patent
Murakoshi et al.

(10) Patent No.: US 10,890,166 B2
(45) Date of Patent: Jan. 12, 2021

(54) NON-PULSATION PUMP HAVING STROKE ADJUSTMENT MECHANISM

(71) Applicant: NIKKISO CO., LTD., Tokyo (JP)

(72) Inventors: Fusao Murakoshi, Hirashimurayama (JP); Hideaki Sato, Hirashimurayama (JP)

(73) Assignee: NIKKISO CO., LTD., Tokyo (JP)

( * ) Notice: Subject to any disclaimer, the term of this patent is extended or adjusted under 35 U.S.C. 154(b) by 48 days.

(21) Appl. No.: 16/327,167

(22) PCT Filed: Apr. 12, 2017

(86) PCT No.: PCT/JP2017/014933

§ 371 (c)(1),
(2) Date: Feb. 21, 2019

(87) PCT Pub. No.: WO2018/042746

PCT Pub. Date: Mar. 8, 2018

(65) Prior Publication Data

US 2019/0195208 A1 Jun. 27, 2019

(30) Foreign Application Priority Data

Sep. 1, 2016 (JP) ..... 2016-170481

(51) Int. Cl.
*F04B 43/02* (2006.01)
*F04B 9/04* (2006.01)
(Continued)

(52) U.S. Cl.
CPC ..... *F04B 9/042* (2013.01); *F04B 9/04* (2013.01); *F04B 11/00* (2013.01); *F04B 11/005* (2013.01); *F04B 13/00* (2013.01); *F04B 43/026* (2013.01)

(58) Field of Classification Search
CPC .. F04B 9/042; F04B 9/04; F04B 11/00; F04B 11/005; F04B 13/00; F04B 9/047;
(Continued)

(56) References Cited

U.S. PATENT DOCUMENTS 2,540,328 A 2/1951 Gray
3,112,705 A * 12/1963 Chlebowski ..... F04B 49/18 417/214
(Continued)

FOREIGN PATENT DOCUMENTS

CN 2391030 Y 8/2000
CN 2491620 Y 5/2002
(Continued)

OTHER PUBLICATIONS

Feb. 7, 2020 extended Search Report issued in European Patent Application No. 17845757.8.
(Continued)

*Primary Examiner* — Charles G Freay
*Assistant Examiner* — Thomas Fink
(74) *Attorney, Agent, or Firm* — Oliff PLC

(57) ABSTRACT

A non-pulsation pump is provided with: a cam mechanism that converts the rotational motion of a shared motor into reciprocal motion having a prescribed phase difference; a plurality of cross heads that make reciprocal motion with a prescribed phase difference through the cam mechanism; and a plurality of reciprocating pumps that are driven with a prescribed phase difference and that include plungers connected to the cross heads, wherein the total discharge flowrate toward a shared discharge pipe is kept constant. This non-pulsation pump includes a preliminary compression step for moving the plungers of the reciprocating pumps to a discharge side by very small amounts before a discharging step but after a suction step, and has a stroke adjustment
(Continued)

mechanism for adjusting the effective stroke length of the plunger in the preliminary compression step. Thus, generation of pulsation can be suppressed even when the set pressure changes.

2 Claims, 12 Drawing Sheets

(51) Int. Cl.
*F04B 13/00* (2006.01)
*F04B 11/00* (2006.01)

(58) Field of Classification Search
CPC .... F04B 43/0009; F04B 43/067; F04B 49/12; F04B 43/026; F04B 43/0736; F04B 1/02; F04B 1/124; F04B 53/14; F04B 53/144; F04B 53/145
USPC ..... 417/218
See application file for complete search history.

(56) References Cited

U.S. PATENT DOCUMENTS

| | | | | |
|---|---|---|---|---|
| 3,857,653 | A | 12/1974 | Mowbray | |
| 4,003,679 | A * | 1/1977 | McManigill | F04B 9/06 417/246 |
| 4,368,010 | A | 1/1983 | Kohlbauer et al. | |
| 5,542,827 | A * | 8/1996 | Dombek | F02M 37/16 417/486 |
| 5,890,415 | A * | 4/1999 | Asou | F04B 53/143 417/470 |
| 5,993,174 | A * | 11/1999 | Konishi | F04B 43/00 417/413.1 |
| 6,293,756 | B1 * | 9/2001 | Andersson | F04B 11/0058 417/3 |
| 9,175,676 | B2 * | 11/2015 | Fortin | F04B 9/14 |
| 10,036,369 | B2 * | 7/2018 | Gaertner | F04B 49/18 |
| 2008/0014106 | A1 | 1/2008 | Hofmann et al. | |
| 2016/0319738 | A1 | 11/2016 | Yamada et al. | |

FOREIGN PATENT DOCUMENTS

| | | | |
|---|---|---|---|
| CN | 105899781 | A | 8/2016 |
| DE | 24 46 805 | A1 | 4/1976 |
| DE | 195 31 064 | A1 | 2/1996 |
| DE | 10 2006 015845 | B3 | 7/2007 |
| GB | 220827 | A | 8/1924 |
| GB | 1480002 | A | 7/1977 |
| JP | S51-061003 | A | 5/1976 |
| JP | S51-122801 | A | 10/1976 |
| JP | S56-030341 | U | 3/1981 |
| JP | H07-119626 | A | 5/1995 |
| JP | H07-119628 | A | 5/1995 |
| JP | H08-114177 | A | 5/1996 |
| JP | 2013-007340 | A | 1/2013 |

OTHER PUBLICATIONS

Nov. 29, 2019 Office Action issued in Chinese Patent Application No. 201780051314.6.
Jul. 11, 2017 Office Action issued in Japanese Patent Application No. 2016-170481.
Jul. 18, 2017 International Search Report issued in International Patent Application No. PCT/JP2017/014933.

* cited by examiner

NON-PULSATION PUMP HAVING STROKE ADJUSTMENT MECHANISM

TECHNICAL FIELD

The present invention relates to a reciprocating pump, and more specifically to a structure of a non-pulsation pump having a constant discharge flow rate.

BACKGROUND

Non-pulsation pumps consisting of multiple, usually two (duplex-type) or three (triplex-type) reciprocating pumps are in use. For example, a duplex-type pump is provided with a common suction pipe, a discharge pipe, and a drive apparatus comprising a cam shaft and a motor, or the like, and is constituted by two reciprocating pumps that are configured such that the plunger of each pump is driven with a prescribed phase difference (in this case, a phase difference of 180°) via an eccentric drive cam. Further, by combining the discharge flow rate of both pumps, the combined discharge flow rate is configured to be constant, and therefore, achieve non-pulsation at all times.

However, in such a non-pulsation pump, the mixing of air into the liquid-contacting parts and the hydraulic drive parts cannot be avoided. Consequently, even if the plunger operates, time is required for the mixed air to be compressed and reach a discharge pressure at a discharge start point, while at a suction start point, time is required for the air to expand and for a negative suction pressure to be reached. As a result, there is a delay in discharging when switching from a suction step to a discharging step, and a loss in the discharge flow rate occurs. Furthermore, in this type of pump, the generation of mechanical play in the driving units cannot be avoided. Consequently, the movement of the plunger is delayed by the amount of the play, which causes a discharge delay due to the mechanical play, and a loss in the discharge flow rate occurs.

In this manner, in this type of conventional non-pulsation pump, precise non-pulsation could not be achieved due to the discharge delay caused by air mixing and mechanical play, and because a loss in the discharge flow rate occurs.

Consequently, a technique is proposed where the non-pulsation characteristics are improved by setting the shape of a drive cam such that a supplementary amount is additionally discharged with respect to the amount of loss in the discharge flow rate in a step immediately before switching to the discharge step, thereby correcting the loss in the discharge flow rate (for example, refer to Patent Document 1).

Furthermore, also proposed is a technique where the non-pulsation characteristics are improved by making the cam a shape in which the flow rate that is additionally discharged immediately before the discharge step becomes larger than a maximum value of the amount of loss in the discharge flow rate, and by a configuration in which the excess amount of the additional discharge to be discharged from an air vent valve (for example, refer to Patent Document 2).

CITATION LIST

Patent Literature

Patent Document 1: JP H07-119626 A
Patent Document 2: JP H08-114177 A

SUMMARY

Technical Problem

However, in a non-pulsation pump using the conventional technique described in Patent Document 1, the amount of loss in the discharge flow rate changes depending on the set pressure, which represents the discharge pressure that is set during operation of the pump. For example, when the set pressure is high, because the volume decrease of the mixed air becomes large, time is required until the set pressure is reached and the amount of loss in the discharge flow rate also becomes large. Conversely, when the set pressure is low, the amount of loss in the discharge flow rate becomes small. Consequently, in the non-pulsation pump described in Patent Document 1, there was a problem that, depending on the set pressure of the pump, pulsation occurred due to the flow rate to be additionally discharged becoming larger than the amount of loss in the discharge flow rate, or conversely, pulsation occurred due to the flow rate to be additionally discharged becoming smaller than the amount of loss in the discharge flow rate.

Furthermore, in a non-pulsation pump using the conventional technique described in Patent Document 2, although the problem of the non-pulsation pump using the conventional technique described in Patent Document 1 is resolved, there was a problem that handling is troublesome due to the need to adjust the flow rate that is discharged from an air vent valve according to the set pressure, or to exchange the adjustment valve to one having a different discharge capacity.

Moreover, in the non-pulsation pump using the conventional technique described in Patent Document 2, although the problem of the non-pulsation pump using the conventional technique described in Patent Document 1 is resolved and there was no problem in its application to hydraulic diaphragm-type pumps, application to packed plunger-type pumps that directly pump a handled liquid was problematic.

Therefore, an object of the present invention is to suppress the generation of pulsation in a variety of applications using a simple method, even when the set pressure changes.

Solution to Problem

A non-pulsation pump of the present invention comprises a cam mechanism that converts a rotational motion of a shared motor into a reciprocal motion having a prescribed phase difference, a plurality of cross heads that make a reciprocal motion with a prescribed phase difference through the cam mechanism, and a plurality of reciprocating pumps that are driven with a prescribed phase difference that include plungers connected to the cross heads, wherein the total discharge flow rate into a shared discharge pipe is kept constant, and the non-pulsation pump includes a preliminary compression step for moving the plungers of the reciprocating pumps to a discharge side by a very small amount after a suction step but before a discharging step, and has a stroke adjustment mechanism that adjusts an effective stroke length of the plunger in the preliminary compression step.

In the non-pulsation pump of the present invention, the stroke adjustment mechanism is attached to the cross head such that an axial direction position with respect to the cross head changes, and may be a stopper that changes the axial direction gap between the cross head and the plunger.

The non-pulsation pump of the present invention may be configured such that the cross head has a bottomed hole formed in a front end portion into which a step portion of a rear end of the plunger is inserted, the stopper has an annular portion that is screwed into a thread portion formed on an inner peripheral surface of the bottomed hole, and a leading end of the annular portion comes into contact with a front surface of the step portion of the plunger.

Advantageous Effects of Invention

The present invention enables the generation of pulsation to be suppressed using a simple method in a variety of applications, even when the set pressure changes.

DESCRIPTION OF EMBODIMENTS

Figure 1:
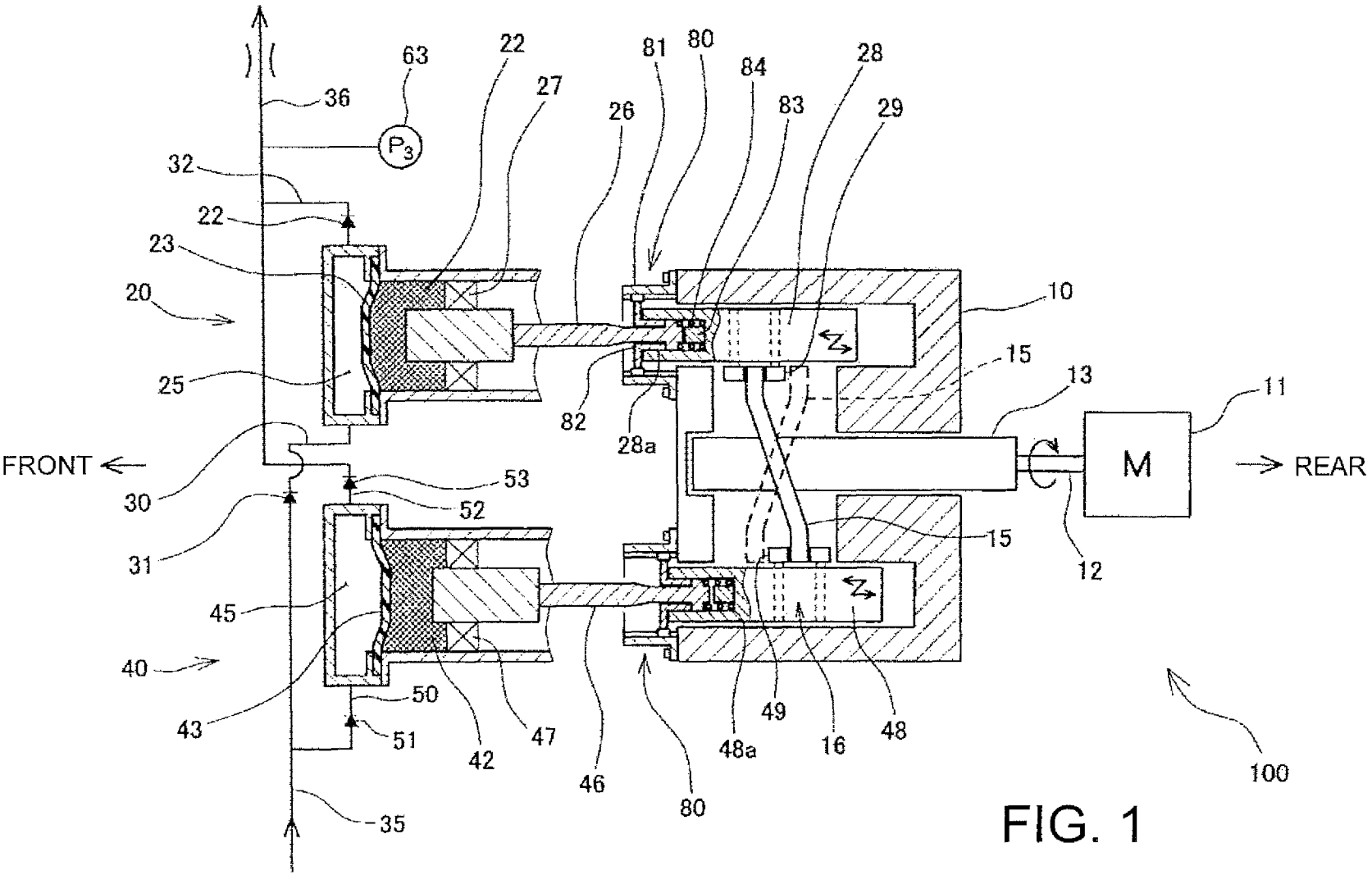
FIG. 1 is a cross-sectional view showing a configuration of a non-pulsation pump according to an embodiment.

A non-pulsation pump 100 of the present embodiment is described below with reference to the drawings. As shown in FIG. 1, the non-pulsation pump 100 of the present embodiment comprises: a frame 10; a specially-shaped rotating cam 15, which is disposed at the center of the frame 10 and is rotated by a motor 11; cross heads 28 and 48 that reciprocate back and forth with a phase difference of 180° through the rotating cam 15; first and second pumps 20 and 40, which are reciprocating pumps including plungers 26 and 46 that are connected to the cross heads 28 and 48; and a stroke adjustment mechanism 80 that adjusts the effective stroke length of the plungers 26 and 46.

As shown in FIG. 1, the rotating cam 15 is a disk-shaped cam which is fixed at an angle to the rotation axis of a shaft 13 rotationally driven by the motor 11, and the leading end is sandwiched between two rollers 29 that are fixed to the cross head 28 of the first pump 20. Furthermore, the opposite side of the rotating cam is sandwiched between two rollers 49 that are fixed to the cross head 48 of the second pump 40. Then, when the rotating cam 15 is rotated by the motor 11, the rotating cam 15 causes the cross heads 28 and 48 to each reciprocate back and forth with a phase difference of 180°. FIG. 1 shows a state in which the plunger 26 of the first pump 20 is in a pushed-out position (discharging step position) and the plunger 46 of the second pump is in a pulled-in position (suction step position). The rotating cam 15 indicated by the dotted line in the diagram represents the position of the rotating cam 15 when the shaft 13 has rotated 180° from the state illustrated by the solid line. The shaft 13, the rotating cam 15, and the rollers 29 and 49 attached to the cross heads 28 and 48 constitute a cam mechanism 16 that converts the rotational motion of the shared motor 11 into a plurality of reciprocating motions having a phase difference of 180°.

The first pump 20 is provided with a hydraulic chamber 22 that stores oil, and a pump chamber 25 that performs suction and discharging of a fluid. The hydraulic chamber 22 and the pump chamber 25 are partitioned by a diaphragm 23. Furthermore, the hydraulic chamber 22 houses the plunger 26, which is connected to the cross head 28 and reciprocates back and forth inside the hydraulic chamber 22, thereby changing the volume of the hydraulic chamber 22. A seal 27 is disposed between an outer peripheral surface of the plunger 26 and an inner peripheral surface of the hydraulic chamber 22 in a configuration in which the oil in the hydraulic chamber 22 is prevented from leaking to the outside. The connective structure between the cross head 28 and the plunger 26 is described later.

A suction pipe 30 that draws a fluid into the pump chamber 25 and a discharge pipe 32 that discharges a fluid from the pump chamber 25 are connected to the pump chamber 25 of the first pump 20. Furthermore, check valves 31 and 33, which prevent backflow of a fluid, are attached to the suction pipe 30 and the discharge pipe 32.

The second pump 40 has the same structure as the first pump 20. In FIG. 1, those elements that are the same as elements of the first pump 20 are denoted by corresponding reference signs in the 40s having the same number in the ones' digit, and the description is omitted. Furthermore, the suction pipe 50 and the discharge pipe 52 of the second pump 40 have check valves 51 and 53 attached in the same manner as the suction pipe 30 and the discharge pipe 32 of the first pump 20.

As shown in FIG. 1, the suction pipe 30 of the first pump 20 and the suction pipe 50 of the second pump 40 are each connected to a shared suction pipe 35. Furthermore, the discharge pipe 32 of the first pump 20 and the discharge pipe 52 of the second pump 40 are each connected to a shared discharge pipe 36.

The shared discharge pipe 36 has a pressure sensor 63 attached that monitors the pressure P3 of the shared discharge pipe 36. This may be any sensor capable of detecting pulsation, such as a flow rate sensor.

Figure 2:
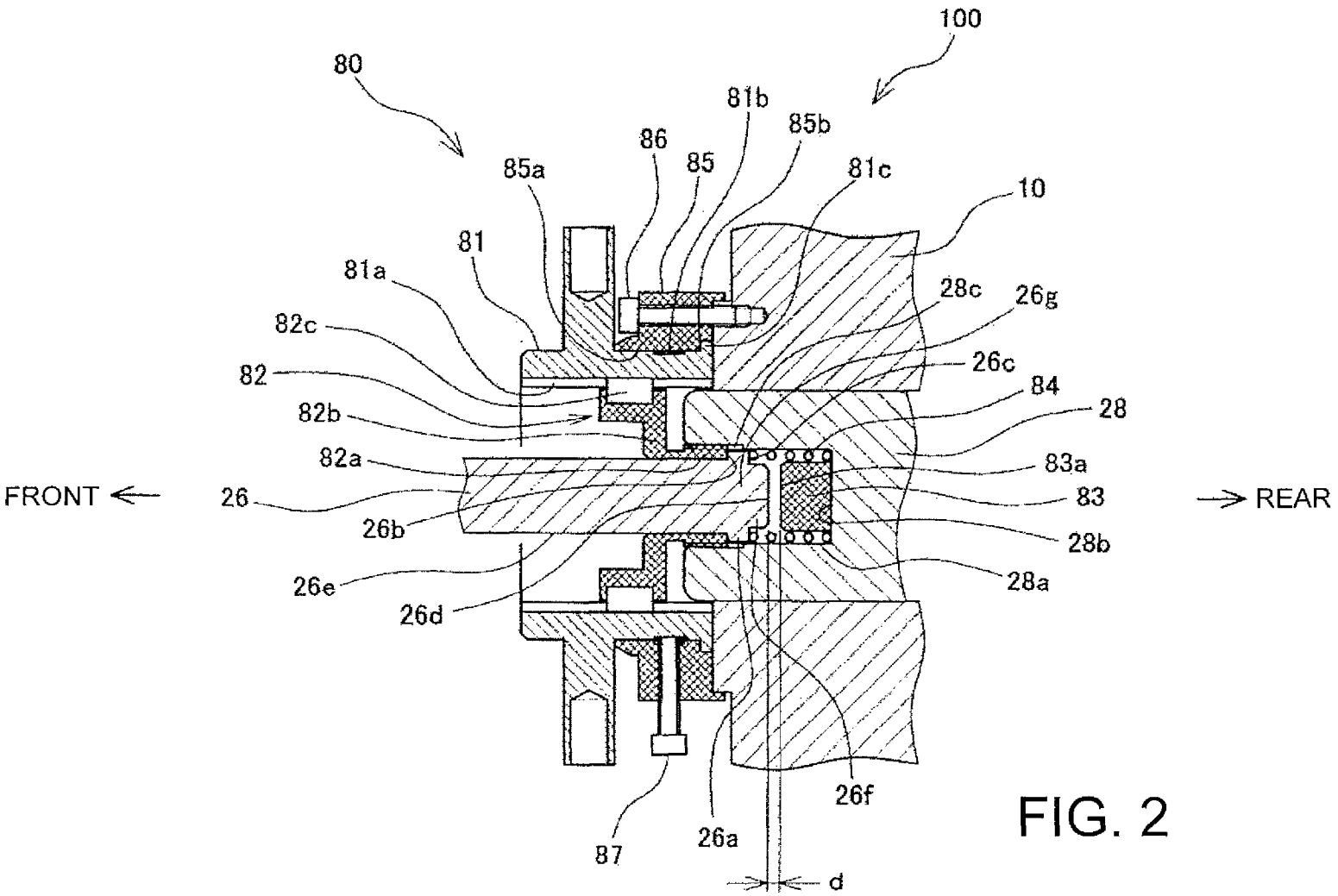
FIG. 2 is a cross-sectional view showing a configuration of a stroke adjustment mechanism of the non-pulsation pump, and is a diagram showing the positional relationship between a cross head and a plunger at the beginning of a preliminary compression step.

Next, the connective structure between the cross head 28 and the plunger 26 and the structure of the stroke adjustment mechanism 80 is described with reference to FIG. 2. As shown in FIG. 2, a front end portion of the cross head 28 is provided with a bottomed hole 28*a* having an inner diameter that is slightly larger than the outer diameter of a step portion 26*a* provided on a rear end 26*g* of the plunger 26. A bottom surface 28*b* of the bottomed hole 28*a* has a reinforcing member 83 attached facing a rear end surface 26*d* of the plunger 26. The outer diameter of the reinforcing member 83 is smaller than the inner diameter of the bottomed hole 28*a*, and a coil spring 84 representing a biasing member is attached between an outer surface of the reinforcing member 83 and an inner surface of the bottomed hole 28*a*. Furthermore, an inner surface on the open side of the bottomed hole 28*a* of the cross head 28 is provided with an inner thread 28*c*.

The stroke adjustment mechanism 80 is provided with a body 81, a support ring 85, and a stopper 82 that slides in a front-rear direction with respect to the body 81.

The stopper 82 is provided with an annular portion 82*a* having an outer thread provided on an outer surface, a plurality of arms 82*b* that extend in a radial direction from the annular portion 82*a*, and a slider 82*c* provided on the leading end of each arm 82*b*. As described later, a through portion 26*e* of the plunger 26 penetrates through the annular portion 82*a*.

The body 81 is provided with a cylindrical surface 81*b* on an inner surface on the frame 10 side, which is an annular member provided with a plurality of guides 81*a* that guide the slider 82*c*. Furthermore, an end surface of the body 81 on the frame 10 side is provided with a flange 81*c* that protrudes further than the cylindrical surface 81*b* on the outer diameter side.

The support ring 85 is an annular-shaped member in which the diameter of an inside cylindrical surface 85*a* is slightly larger than the outer diameter of the cylindrical surface 81*b* of the body 81, and a notch 85*b* is provided in a position that corresponds to the flange 81*c* of the body 81. Furthermore, the support ring 85 has a bolt 87 attached that can be inserted and retracted in the radial direction.

The rear end 26*g* of the plunger 26 is provided with the through portion 26*e*, which is narrower than the inner diameter of the annular portion 82*a* of the stopper 82, the step portion 26*a*, which has having an outer diameter that is larger than the inner diameter of the annular portion 82*a*, and a rear end portion 26*f* having the same diameter as the through portion 26*e*.

As shown in FIG. 2, after inserting the reinforcing member 83 into the bottomed hole 28*a* of the cross head 28 and attaching the coil spring 84 between the reinforcing member 83 and an inner surface of the bottomed hole 28*a*, the rear surface 26*c* of the step portion 26*a* of the plunger 26 makes contact with one end of the coil spring 84 when the rear surface 26*g* of the plunger 26 is inserted into the bottomed hole 28*a*. Consequently, the coil spring 84 becomes sandwiched between the bottom surface 28*b* of the bottomed hole 28*a* and the rear surface 26*c* of the step portion 26*a* of the plunger 26.

Then, when the support ring 85 of the stroke adjustment mechanism 80 is assembled with the frame 10 with the bolt 86, the notch 85*b* of the support ring 85 presses the flange 81*c* of the body 81 against the frame 10, thereby assembling the body 81 with the frame 10. Because the diameter of the cylindrical surface 85*a* of the support ring 85 is slightly larger than the outer diameter of the cylindrical surface 81*b* of the body 81, the body 81 is rotatably attached with respect to the frame 10. Further, when the body 81 is rotated clockwise after pushing the leading end of the annular portion 82*a* of the stopper 82 to the rear side into a position where it aligns with the inner thread 28*c* of the cross head 28, an external thread formed on an outer surface of the annular portion 82*a* is screwed into the inner thread 28*c* of the cross head 28, and the annular portion 82*a* of the stopper 82 moves into the cross head 28. Then, a front end surface of the annular portion 82*a* makes contact with the front surface 26*b* of the step portion 26*a* of the plunger 26. Further, as the body 81 is rotated further clockwise, a front end surface of the annular portion 82*a* of the stopper 82 starts to press against the coil spring 84 via the step portion 26*a* of the plunger 26. At the time of assembly, the body 81 is rotated until the gap between the rear end surface 26*d* of the plunger 26 and the front end surface 83*a* of the reinforcing member 83 becomes a prescribed width d. When the gap between the rear end surface 26*d* of the plunger 26 and the front end surface 83*a* of the reinforcing member 83 becomes the prescribed width d, the bolt 87 is fastened and the body 81 is fixed to prevent it from rotating.

Figure 6:
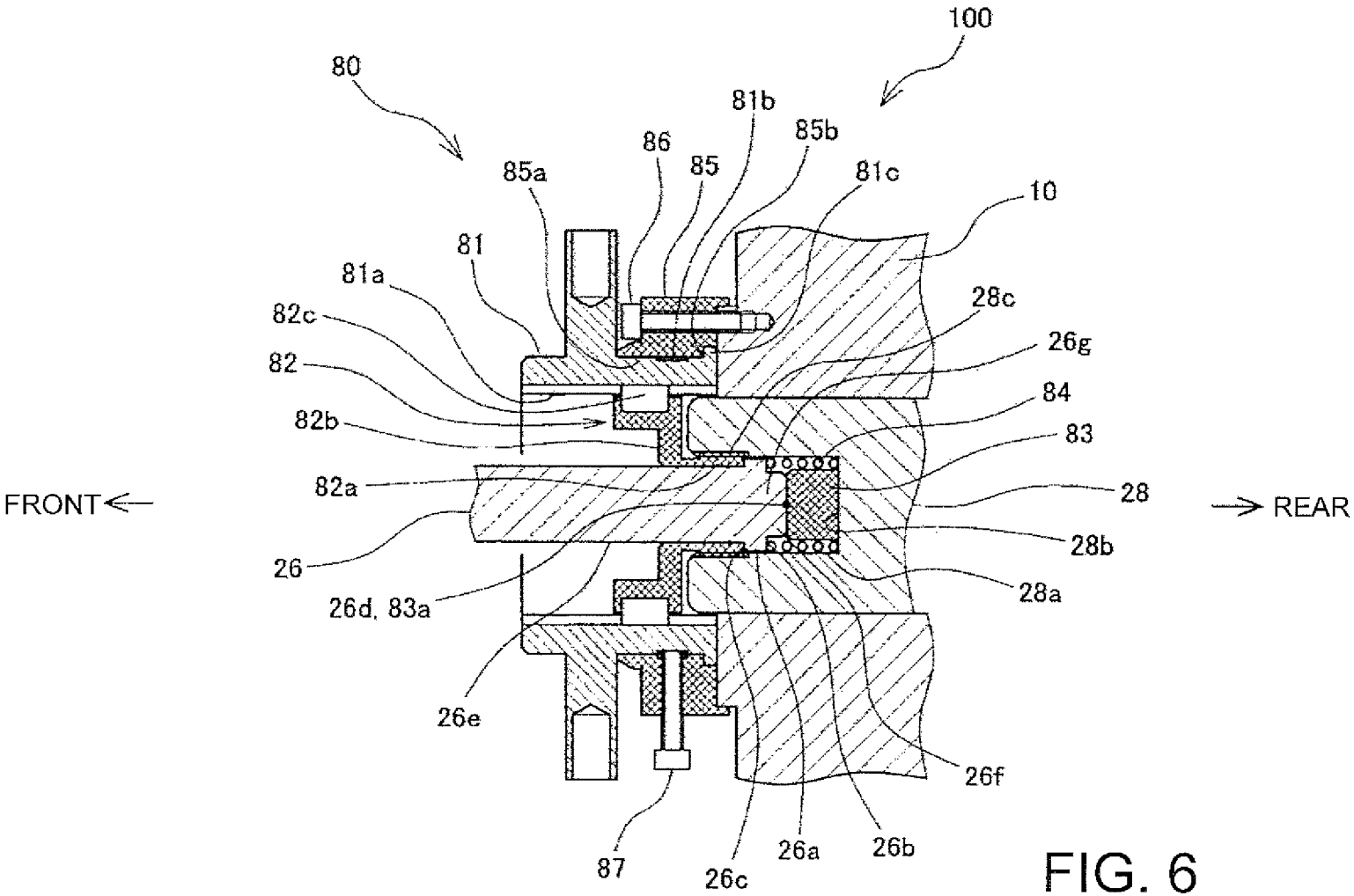
FIG. 6 is a diagram showing the positional relationship between the cross head and the plunger during the preliminary compression step in a case where the stroke adjustment mechanism shown in FIG. 2 has reduced the gap between the cross head and the plunger to zero.

If the cross head 28, the plunger 26, and the stroke adjustment mechanism 80 are assembled in this manner, as shown in FIG. 2, the plunger 26 is biased from the cross head 28 toward the stopper 82 by the coil spring 84, and the rear end surface 26*d* of the plunger 26 and the front end surface 83*a* of the reinforcing member 83 are in a state where a gap having the prescribed width d has been formed. The width d of the gap may be adjusted by adjusting the axial direction position of the stopper 82 by rotating the body 81, and as shown in FIG. 6, the width d of the gap may also be reduced to zero by screwing in the body 81 further clockwise. The stopper 82 makes a reciprocating motion back and forth together with the cross head 28 as a result of the slider 82*c* being guided by the guide 81*a* of the body 81.

Next, an operation of the non-pulsation pump 100 configured as above is described. In the non-pulsation pump 100, when the rotating cam 15 is rotated by the motor 11, the cross heads 28 and 48 reciprocate with a phase difference of 180° through the rotating cam 15, and a fluid is pumped without pulsation by alternatingly discharging the fluid in the pump chambers 25 and 45 into the shared discharge pipe 36. In the following description, the discharge pressure set during operation of the pump is referred to as the set pressure P*, and the discharge pressure at the time a speed curve of the plunger 26 is determined with respect to a rotation angle φ during the preliminary compression step is referred to as the design pressure Pd.

<Non-Pulsation Pump Operation when Set Pressure P* Equals Design Pressure Pd and Gap Between Cross Head and Plunger is Set to Zero>

Figure 7:
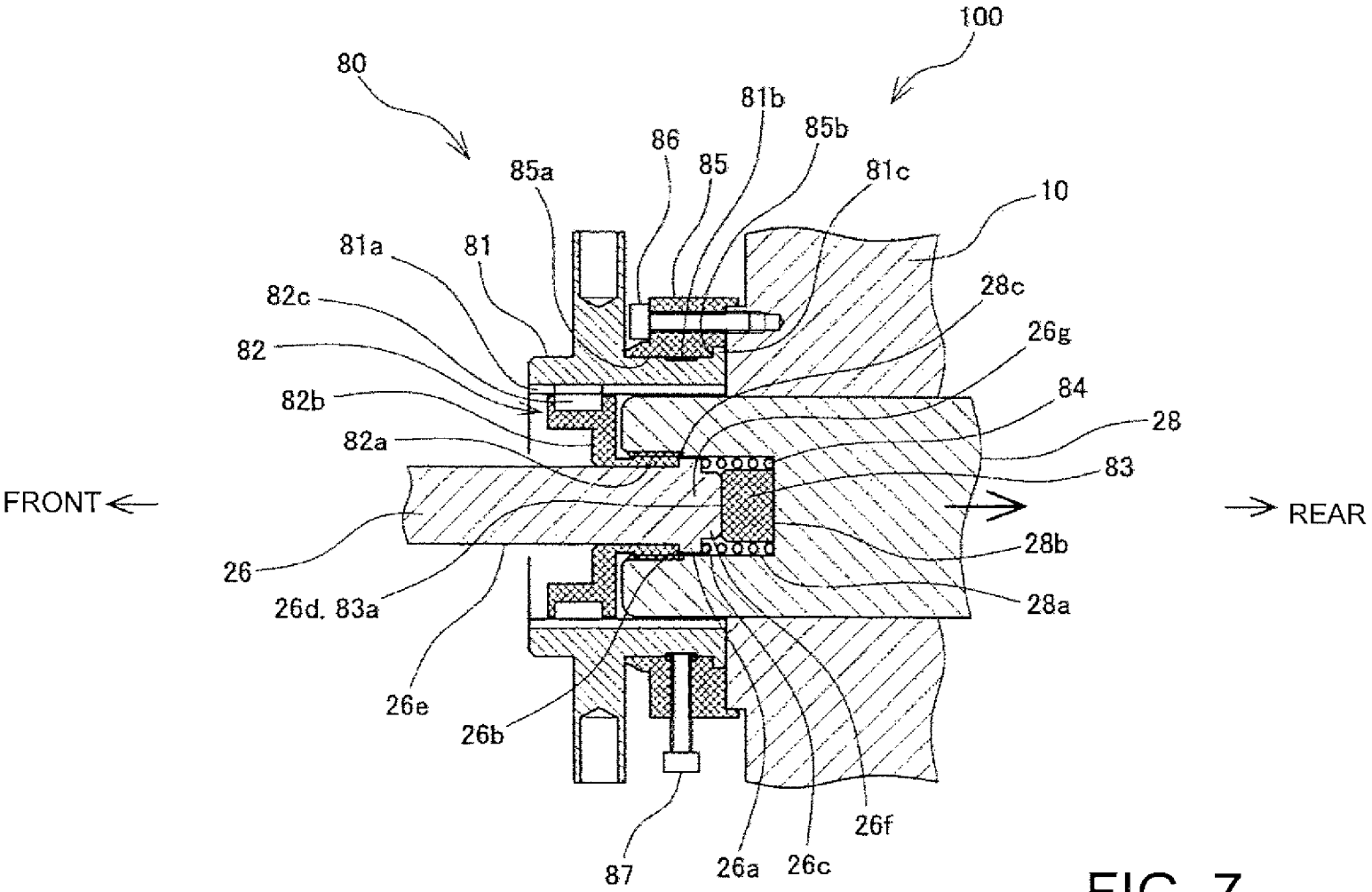
FIG. 7 is a diagram showing the positional relationship between the cross head and the plunger during the discharging step in a case where the stroke adjustment mechanism shown in FIG. 2 has reduced the gap between the cross head and the plunger to zero.

Firstly, the operation of the non-pulsation pump 100 is described for a case where the set pressure P*, which represents the discharge pressure set during operation of the pump, is equal to the design pressure Pd, which represents the discharge pressure at the time a speed curve of the plunger 26 is determined with respect to a rotation angle φ during the preliminary compression step. In this case, as shown in FIG. 6 and FIG. 7, the width of the gap between the cross head 28 and the plunger 26 is adjusted such that it is reduced to zero, and the cross head 28 and the plunger 26 constantly make a reciprocal motion in a front-rear direction as an integral unit during the preliminary compression step, a compression step, a resting step, and the suction step.

Figure 8A:
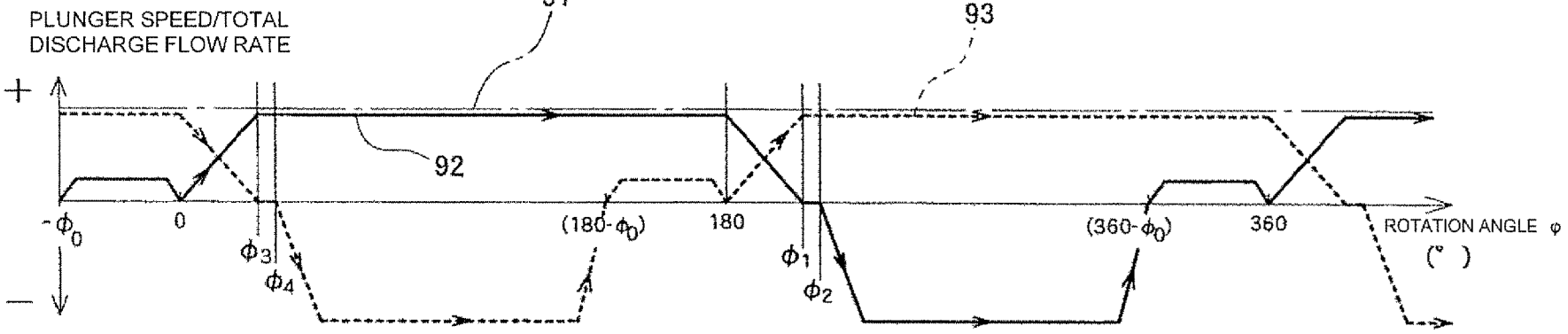
FIG. 8A is a graph showing the change over time in the plunger speed and total discharge flow rate of the non-pulsation pump shown in FIG. 1.

In FIG. 8A, the solid line 92 represents the speed of the plunger 26 of the first pump 20 with respect to the rotation angle φ of the shaft 13, that is to say, the rotation angle φ of the motor 11, the dotted line 93 represents the speed of the plunger 46 of the second pump 40, and the dash-dotted line 91 represents the total discharge flow rate of the first pump 20 and the second pump 40, or in other words, the change in the fluid flow rate discharged into the shared discharge pipe 36. In FIG. 8A, a positive plunger speed indicates that the plunger 26 is moving (advancing) in a direction that discharges a fluid from the pump chamber 25, and a negative plunger speed indicates that the plunger 26 is moving (retracting) in a direction that results in suction of a fluid into the pump chamber 25.

In the non-pulsation pump 100 of the present embodiment, the mixing of air into the hydraulic chambers 22 and 42 cannot be avoided, and further, a small amount of play exists in the drive units. Therefore, the non-pulsation pump 100 of the present embodiment has a preliminary compression step that supplements a loss in the discharge flow rate by temporarily stopping the plungers 26 and 46 after moving the plungers 26 and 46 to the discharge side (forward side) by a very small amount in the step immediately before switching from the suction step to the discharging step, compressing the mixed air bubbles beforehand by increasing the pressure of the hydraulic chambers 22 and 42, and also removing non-driven parts of the plungers 26 and 46 that are caused by the small amount of play through a change in the movement direction of the plungers 26 and 46 before the start of discharging.

As indicated by the solid line 92 in FIG. 8A, the first pump 20 performs the preliminary compression step described above when the rotation angle φ is between −φ0 and 0°, the discharging step when the rotation angle φ is between 0° and the rotation angle φ1, the resting step between the rotation angle φ1 and the rotation angle φ2, the suction step between the rotation angle φ2 and (360°−φ0), and then, from a rotation angle φ of (360°−φ0) (=−φ0), the preliminary compression step, the discharging step, the resting step, and the suction step are repeated in the same manner as above.

On the other hand, as indicated by the dotted line 93 in FIG. 8A, the second pump 40 performs the discharging step when the rotation angle φ is between −φ0 and the rotation angle φ3, the resting step between the rotation angle φ3 and the rotation angle φ4, the suction step between the rotation angle φ4 and a rotation angle φ of (180°−φ0), the preliminary compression step between a rotation angle φ of (180°−φ0) and 180°, and the discharging step beyond a rotation angle φ of 180°. The second pump 40 performs the preliminary compression step, the discharging step, the resting step, and the suction step such that the rotation angle φ is offset by 180° from the first pump 20.

As indicated by the solid line 92 in FIG. 8A, in the preliminary compression step that occurs for a rotation angle φ between −φ0 and 0°, the plunger 26 in the first pump 20 moves through the specially-shaped rotating cam 15 in a direction that discharges a fluid at a very low speed that is lower than the normal speed of the discharging step that occurs between the rotation angle φ3 and a rotation angle φ of 180°. Then, the movement is stopped when the rotation angle φ reaches φ1. The position of the plunger 26 at this time is represented by the solid line 95 in FIG. 8B. As indicated by the solid line 95 in FIG. 8B, the plunger 26 slowly rises from a 0% position (pulled-in position) from a rotation angle φ of −φ0 until immediately before a rotation angle φ of 0°, and the movement of the plunger 26 temporarily stops once the rotation angle φ reaches 0° (preliminary compression step). In this manner, air bubbles inside the hydraulic chamber 22 collapse as a result of the plunger 26 slowly moving in the discharging direction, and the hydraulic pressure of the hydraulic chamber 22 rises. Then, as indicated by the solid line 97 in FIG. 8C, at a rotation angle φ of 0° the diaphragm 23 starts moving toward the pump chamber 25 side, and the pressure P1 of the pump chamber 25 reaches the pressure P3 of the shared discharge pipe 36, that is to say, approximately the same pressure as the set pressure P*, and the discharging of fluid from the pump chamber 25 into the shared discharge pipe 36 is started. On the other hand, as indicated by the dotted line 93 in FIG. 8A, the second pump 40 starts decreasing the plunger speed and the discharge flow rate from a rotation angle of 0°. The increase in the discharge amount from a rotation angle φ of 0° in the first pump 20 and the decrease in the discharge amount from a rotation angle of 0° in the second pump offset each other, thereby causing a fluid to flow into the shared discharge pipe 36 at a constant flow rate. Furthermore, the pressure P3 of the shared discharge pipe 36 is also constantly maintained at the set pressure P*. Then, the speed of the plunger 26 increases at a fixed rate from a rotation angle φ of 0° to the rotation angle φ3 through the specially-shaped rotating cam 15, and thereafter moves in the discharging direction at a constant speed (discharging step). The speed changes of the plunger 26 shown in FIG. 8A are caused by the specially-shaped rotating cam 15, and the rotation speed of the motor 11 is constant.

Figure 8B:
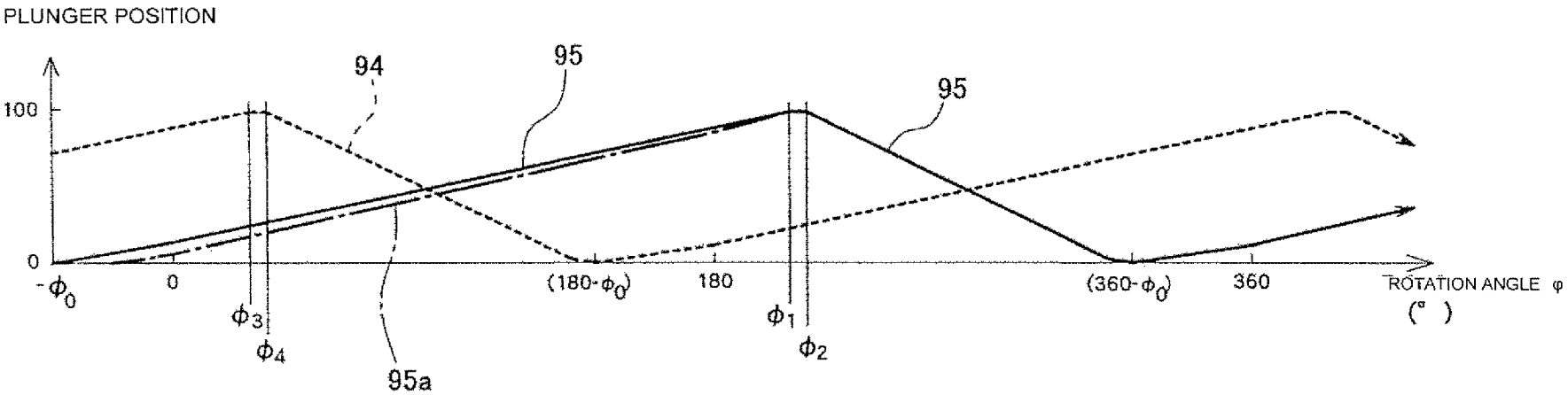
FIG. 8B is a graph showing the change over time in the plunger position of the non-pulsation pump shown in FIG. 1.

As indicated by the solid line 95 in FIG. 8B, the plunger 26 reaches a 100% position (pushed-out position) at the rotation angle φ1, and maintains the state of the 100% position (pushed-out position) until the rotation angle φ2 (resting step). Thereafter, as indicated by the solid line 92 in FIG. 8A, when the speed of the plunger 26 becomes negative, the plunger 26 moves toward the opposite side to the pump chamber 25, from the 100% position (pushed-out position) toward the 0% position (pulled-in position). Consequently, when the rotation angle φ reaches φ2, the pressure P1 of the pump chamber 25 becomes a negative suction pressure in the manner of the solid line 97 in FIG. 8C, resulting in suction of a fluid into the pump chamber 25 (suction step). When the suction step ends at a rotation angle φ of (360°−φ0), the pressure P1 of the pump chamber 25 becomes a slight positive pressure approximately equal to the head pressure of a suction tank (not illustrated) connected to the suction pipe 35 of approximately 0.01 Mpa for example. Then, from a rotation angle φ of (360°−φ0), the preliminary compression step, the discharging step, the resting step, and the suction step are repeated in the same manner as described above.

Figure 8C:
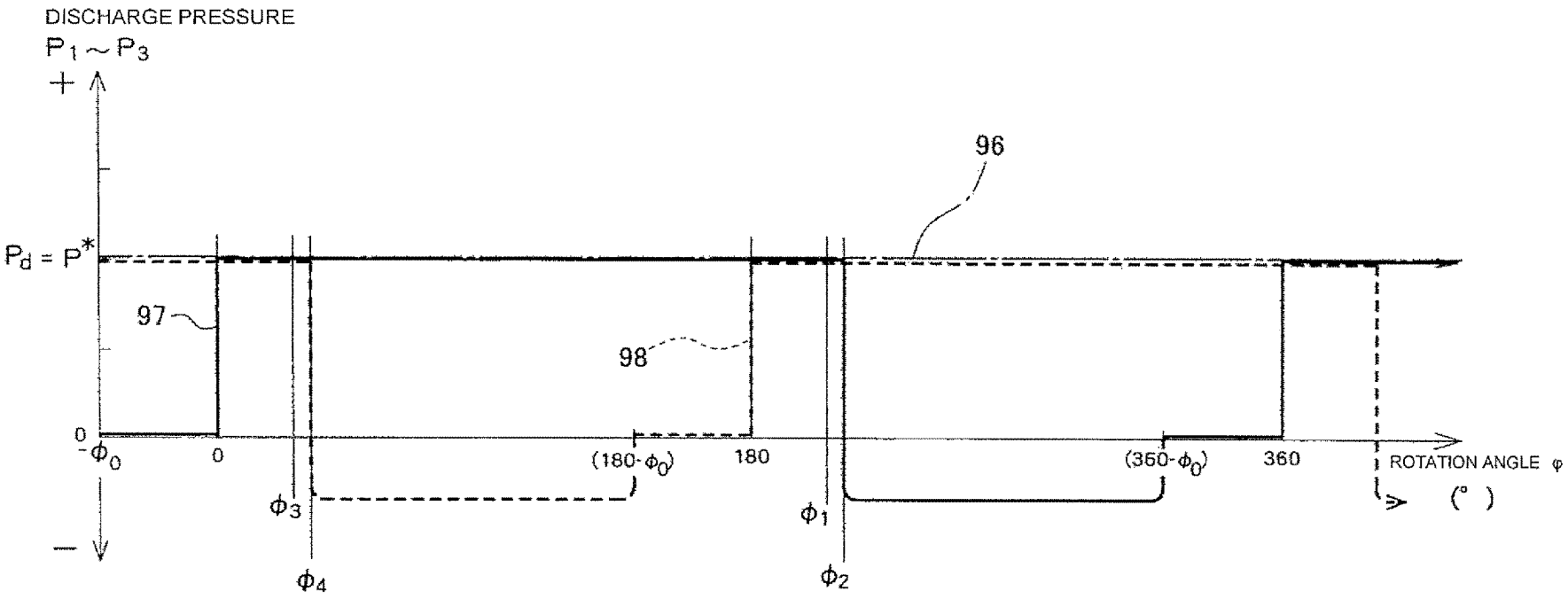
FIG. 8C is a graph showing the change over time in the discharge pressure of the non-pulsation pump shown in FIG. 1 in a case where the set pressure P* is equal to the design pressure Pd, and the gap between the cross head and the plunger has been reduced to zero.

As indicated by the dotted line 94 in FIG. 8B and the dotted line 98 in FIG. 8C, the plunger 46 of the second pump 40 reciprocates between the 0% position (pulled-in position) and the 100% position (pushed-out position) with an offset in the rotation angle φ of 180° relative to the plunger 26 of the first pump 20 represented by the solid line 95 in FIG. 8B and the solid line 97 in FIG. 8C.

In this manner, the plunger 26 of the first pump 20 and the plunger 46 of the second pump 40 reciprocate between the 0% position (pulled-in position) and the 100% position (pushed-out position) with an offset in the rotation angle φ of 180°, and in a case where the pressure P* is equal to the design pressure Pd and, as shown in FIG. 6, the gap between the cross head 28 and the plunger 26 is adjusted such that it is reduced to zero, the pressure P1 of the pump chamber 25 of the first pump 20 becomes an approximately equal pressure to the pressure P3 (set pressure P*) of the shared discharge pipe 36 at the end of the preliminary compression step (rotation angle φ of 0°), thereby causing the discharging of fluid without delay from the pump chamber 25 into the shared discharge pipe 36 simultaneously with the start of the discharging step of the first pump 20. Then, the increase in the discharge amount from a rotation angle φ of 0° in the first pump 20 and the decrease in the discharge amount from a rotation angle φ of 0° in the second pump 40 offset each other, thereby causing the total discharge flow rate of the first pump 20 and the second pump 40 to become a constant, rated flow rate without pulsation as shown by the dash-dotted line 91 in FIG. 8A. Furthermore, the pressure P3 of the shared discharge pipe 36 also becomes a constant pressure without pulsation as indicated by the dash-dotted line 96 in FIG. 8C.

<Non-Pulsation Pump Operation when Set Pressure P* is Lower than Design Pressure Pd and Gap Between Cross Head and Plunger is Set to Zero>

Figure 8D:
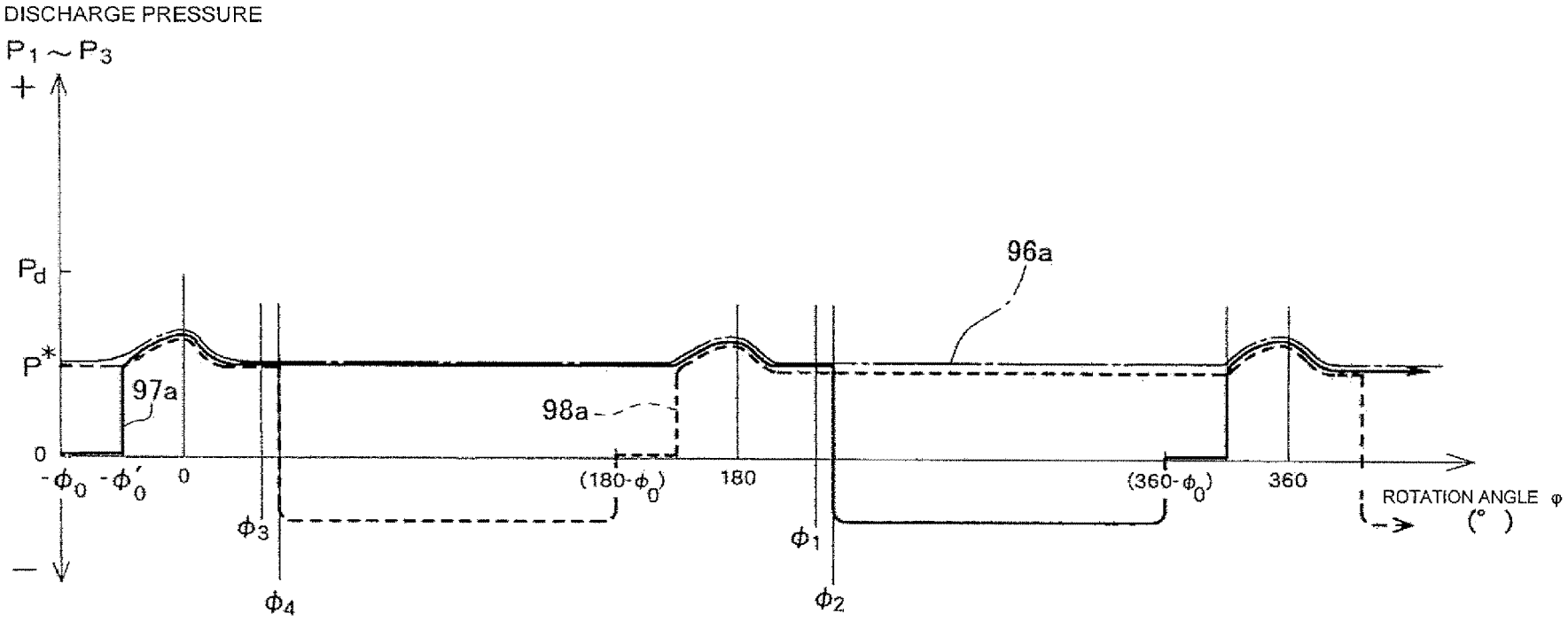
FIG. 8D is a graph showing the change over time in the discharge pressure of the non-pulsation pump shown in FIG. 1 in a case where the set pressure P* is smaller than the design pressure Pd, and the gap between the cross head and the plunger has been reduced to zero.

When the pressure P3 of the shared discharge pipe 36, that is, the set pressure P* is lower than the design pressure Pd, the loss in the discharge flow rate is small, and if the preliminary compression step is performed using a constant rotation of the motor 11 with the gap between the cross head 28 and the plunger 26 reduced to zero in the same manner as described above, as indicated by the solid line 97*a* in FIG. 8D, the pressure P1 of the pump chamber 25 reaches the pressure P3 (set pressure P*) of the shared discharge pipe 36 before the end of the preliminary compression step, for example, when the rotation angle φ is −φ0', and the discharging of fluid occurs from the pump chamber 25 into the shared discharge pipe 36 during the preliminary compression step. As indicated by the dotted line 93 in FIG. 8A, when the rotation angle φ is −φ0' the plunger 46 of the second pump 40 moves at a constant speed in the discharging direction, and a prescribed flow rate is being discharged from the pump chamber 45 into the shared discharge pipe 36. Consequently, the fluid flow rate that flows into the shared discharge pipe 36 becomes a total flow rate consisting of the constant flow rate discharged from the second pump 40 and the fluid flow rate discharged from the first pump 20, and the pressure P3 of the shared discharge pipe 36 exceeds the set pressure P* as indicated by the dash-dotted line 96*a* in FIG. 8D, thereby causing pulsation to be generated in the total discharge flow rate. Therefore, in a case where the set pressure P* is lower than the design pressure Pd, the non-pulsation pump 100 of the present embodiment suppresses the generation of pulsation by, as shown in FIG. 2, adjusting the effective stroke length during the preliminary compression step by rotating the stopper 82 of the stroke adjustment mechanism 80 such that the gap between the cross head 28 and the plunger 26 becomes a width d. This is described below. In the following description, the width d is assumed to be equal to the length of the distance the cross head 28 has advanced over the time the rotation angle φ has moved from −φ0 to −φ0'.

<Non-Pulsation Pump Operation when Set Pressure P* is Lower than Design Pressure Pd and Gap Between Cross Head and Plunger is Set to Prescribed Width d>

As shown in FIG. 2, when the set pressure P* is lower than the design pressure Pd, the stopper 82 of the stroke adjustment mechanism 80 is rotated such that the gap between the cross head 28 and the plunger 26 is adjusted such that it becomes a width d. Here, the width d is equal to the length the cross head 28 advances over the time the rotation angle φ has moved from −φ0 to −φ0'.

Figure 5:
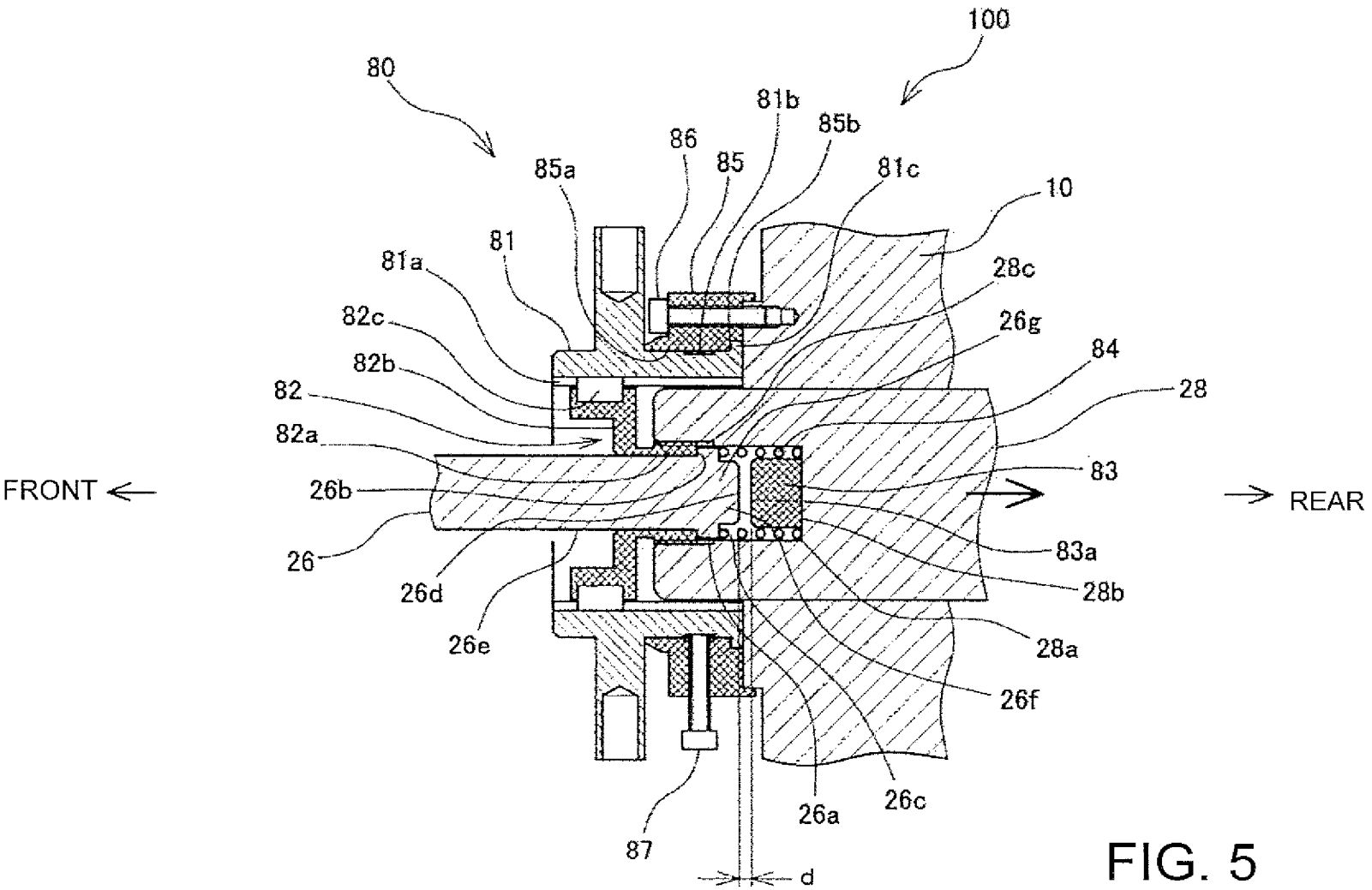
FIG. 5 is a cross-sectional view showing the configuration of the stroke adjustment mechanism shown in FIG. 2, and is a diagram showing the positional relationship between the cross head and the plunger at the beginning of a suction step.

As described previously with reference to FIG. 8C, in the suction step that occurs when the rotation angle φ is between φ2 and (360°−φ0), the pressure P1 of the pump chamber 25 becomes a negative suction pressure. Consequently, the plunger 26 does not retract even when the cross head 28 retracts, and a gap begins to form between the cross head 28 and the plunger 26. Further, when the gap becomes the width d, as shown in FIG. 5, a rear side surface of the annular portion 82*a* of the stopper 82 that is screwed into a leading end of the cross head 28 makes contact with the front surface 26*b* of the step portion 26*a* of the plunger 26, thereby pulling the plunger 26 back to the 0% position (pulled-in position). Therefore, in the suction step that occurs when the rotation angle φ is between φ2 and (360°−φ0), as shown in FIG. 5, the gap between the cross head 28 and the plunger 26 is set to the width d. Further, at the end of the suction step, as shown in FIG. 2, the gap between the cross head 28 and the plunger 26 is set to the width d even at the start of the preliminary compression step (rotation angle φ of 360°−φ0 and −φ0).

Figure 8E:
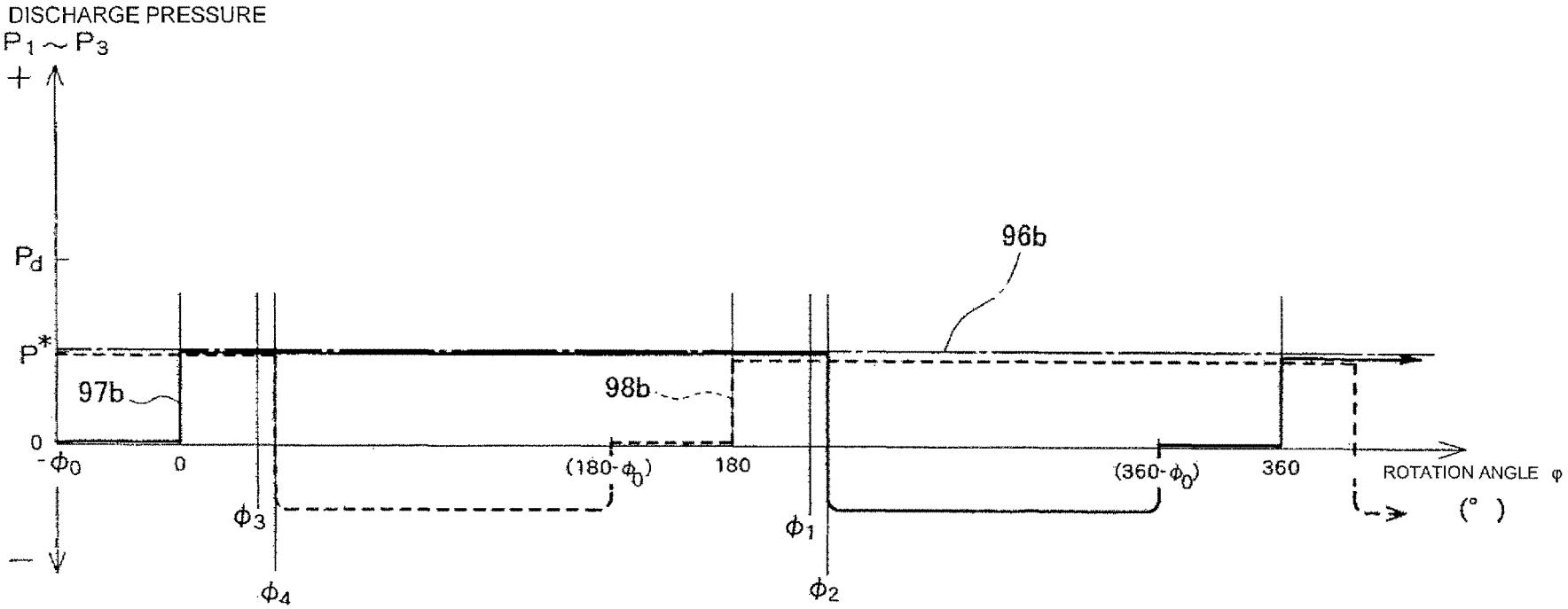
FIG. 8E is a graph showing the change over time in the discharge pressure of the non-pulsation pump shown in FIG. 1 in a case where the set pressure P* is smaller than the design pressure Pd, and the gap between the cross head and the plunger has been set to a prescribed width d.

As described previously, at a rotation angle φ at the end of the suction step (start of the preliminary compression step) of −φ0 (360° φ0) in the first pump 20, as indicated by the solid line 97*b* in FIG. 8E, the pressure P1 of the pump chamber 25 is a slight positive pressure approximately equivalent to the head pressure of a suction tank (not illustrated) connected to the shared suction pipe 35 of approximately 0.01 Mpa for example.

As shown in FIG. 8B, when the preliminary compression step starts from a rotation angle φ of −φ0, the motor 11 rotates and the cross head 28 starts to advance. As mentioned previously, the pressure P1 of the pump chamber 25 at the start of the preliminary compression step (rotation angle φ of −φ0) is approximately 0.01 Mpa for example, and because the biasing force of the coil spring 84 is smaller than the force applied from the pump chamber 25 to the plunger 26, as indicated by the dash-dotted line 95*a* in FIG. 8, the plunger 26 does not advance even when the cross head 28 advances due to the rotation of the motor 11, and the coil spring 84 that is attached between the plunger 26 and the cross head 28 starts to become compressed.

Figure 3:
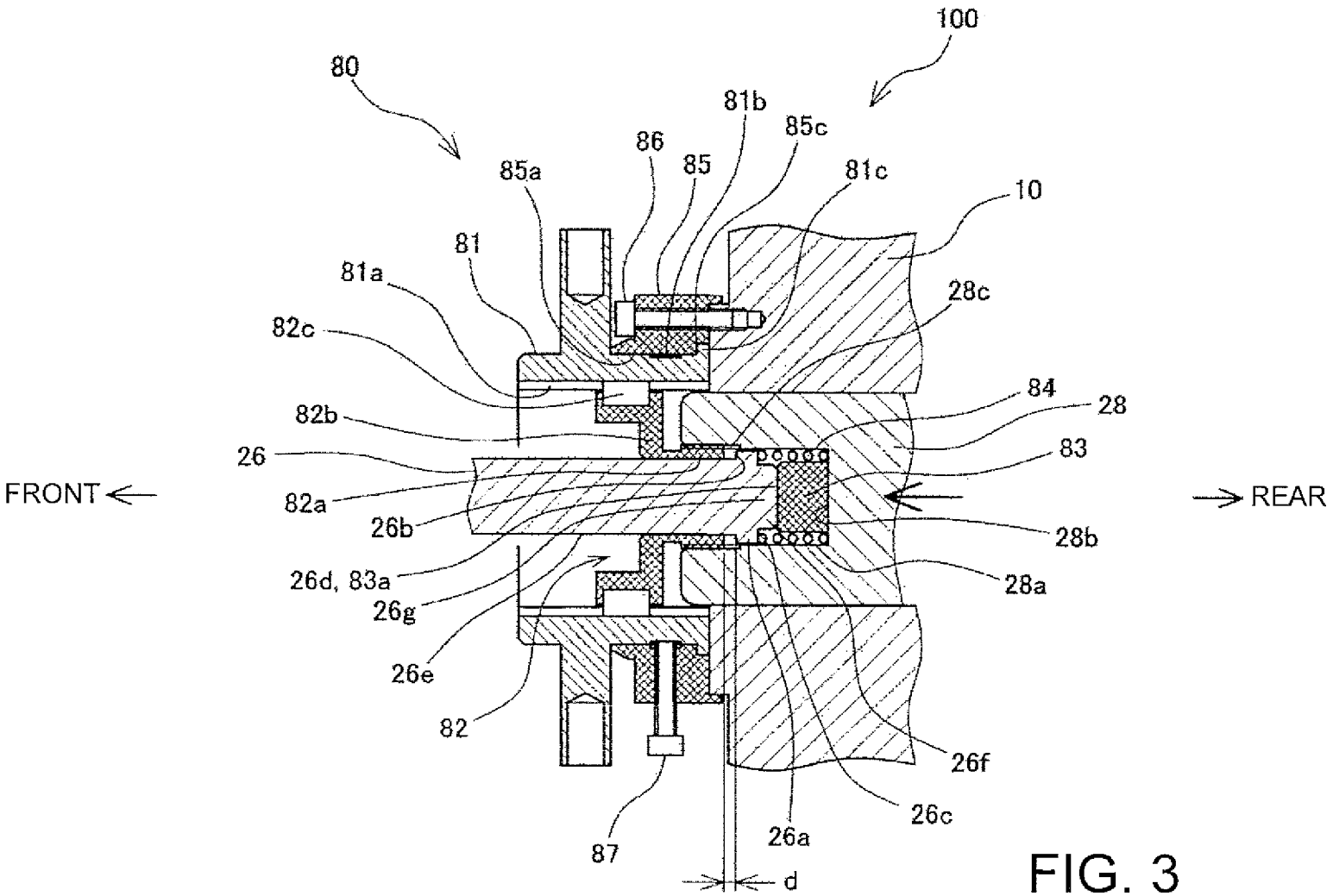
FIG. 3 is a cross-sectional view showing the configuration of the stroke adjustment mechanism shown in FIG. 2, and is a diagram showing a state in which the gap between the cross head and the plunger has become zero during the preliminary compression step.
Figure 4:
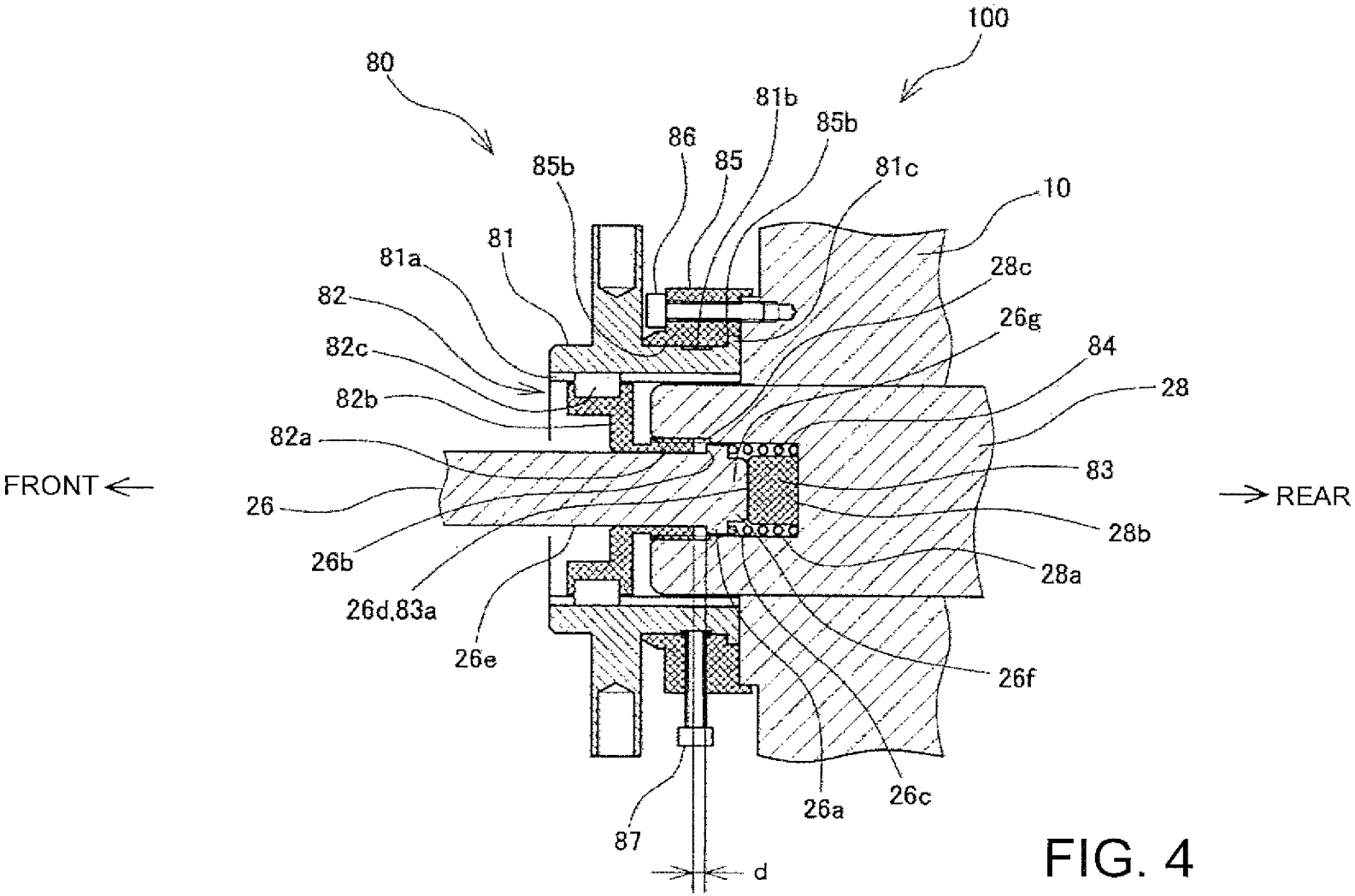
FIG. 4 is a cross-sectional view showing the configuration of the stroke adjustment mechanism shown in FIG. 2, and is a diagram showing the positional relationship between the cross head and the plunger during a discharging step.

Then, when the rotation angle φ reaches −φ0', as shown in FIG. 3, the gap between the cross head 28 and the plunger 26 becomes zero, and as indicated by the dash-dotted line 95*a* in FIG. 8B, the plunger 26 starts to move in the discharging direction due to the rotation of the motor 11. From a rotation angle φ of −φ0', the air bubbles inside the hydraulic chamber 22 collapse as a result of the movement of the plunger 26 in the discharging direction due to the rotation of the motor 11, and the hydraulic pressure in the hydraulic chamber 22 starts to rise. However, because the diaphragm 23 has not started moving, as indicated by the solid line 97*b* in FIG. 8E, the pressure P1 of the pump chamber 25 has not yet changed. Then, when the rotation angle φ reaches 0°, because the diaphragm 23 starts to move to the pump chamber 25 side, as indicated by the solid line 97*b* in FIG. 8E, the pressure P1 of the pump chamber 25 reaches the pressure of pressure P3 of the shared discharge pipe 36, that is to say, approximately the same pressure as the set pressure P*, and the discharging of fluid from the pump chamber 25 into the shared discharge pipe 36 is started. Further, when the rotation angle φ is increased from 0° to start the discharging step, as shown in FIG. 4, the cross head 28 and the plunger 26 advance as an integral unit and start the discharging of fluid from the pump chamber 25 into the shared discharge pipe 36.

On the other hand, as indicated by the dotted line 93 in FIG. 8A, the second pump 40 starts decreasing the plunger speed and the discharge flow rate from a rotation angle of 0°. The increase in the discharge amount from a rotation angle φ of 0° in the first pump 20 and the decrease in the discharge amount from a rotation angle of 0° in the second pump offset each other, thereby causing a fluid to flow into the shared discharge pipe 36 at a constant flow rate. Furthermore, the pressure P3 of the shared discharge pipe 36 is also constantly maintained at the set pressure P*. The speed of the plunger 26 increases at a fixed rate from a rotation angle φ of 0° to the rotation angle φ3 through the specially-shaped rotating cam 15, and thereafter moves in the discharging direction at a constant speed until a rotation angle φ of 180° (discharging step). The speed changes of the plunger 26 shown in FIG. 8A are caused by the specially-shaped rotating cam 15, and the rotation speed of the motor 11 is constant.

As indicated by the solid line 95 in FIG. 8B, the plunger 26 reaches the 100% position (pushed-out position) at the rotation angle φ1. As shown in FIG. 4, the gap between the cross head 28 and the plunger 26 is reduced to zero at the rotation angle φ1. The plunger 26 maintains the state of the 100% position (pushed-out position) until the rotation angle φ2 (resting step). Thereafter, as indicated by the solid line 92 in FIG. 8A, when the speed of the plunger 26 becomes negative, the plunger 26 moves toward the opposite side to the pump chamber 25, from the 100% position (pushed-out position) toward the 0% position (pulled-in position). Consequently, when the suction step starts from the rotation angle φ2, the pressure P1 of the pump chamber 25 becomes a negative suction pressure in the manner of the solid line 97*b* in FIG. 8E. As described previously, the plunger 26 does not retract even when the cross head 28 retracts, and a gap begins to form between the cross head 28 and the plunger 26. Further, when the gap becomes the width d, as shown in FIG. 5, a rear side surface of the annular portion 82*a* of the stopper 82 that is screwed into a leading end of the cross head 28 makes contact with the front surface 26*b* of the step portion 26*a* of the plunger 26, thereby pulling the plunger 26 back to the 0% position (pulled-in position). Therefore, in the suction step that occurs when the rotation angle φ is between φ2 and (360°−φ0), the gap between the cross head 28 and the plunger 26 is set to the width d. When the suction step ends at a rotation angle φ of (360°−φ0), the pressure P1 of the pump chamber 25 becomes a slight positive pressure approximately equal to the head pressure of a suction tank (not illustrated) connected to the suction pipe 35 of approximately 0.01 Mpa for example. Then, from a rotation angle φ of (360°−φ0), the preliminary compression step, the discharging step, the resting step, and the suction step are repeated in the same manner as described above.

As indicated by the dotted line 94 in FIG. 8B and the dotted line 98*b* in FIG. 8E, the plunger 46 of the second pump 40 reciprocates between the 0% position (pulled-in position) and the 100% position (pushed-out position) with an offset in the rotation angle φ of 180° relative to the plunger 26 of the first pump 20 represented by the dash-dotted line 95*a* in FIG. 8B and the solid line 97*b* in FIG. 8E.

In this manner, the plunger 26 of the first pump 20 and the plunger 46 of the second pump 40 reciprocate between the 0% position (pulled-in position) and the 100% position (pushed-out position) with an offset in the rotation angle φ of 180°, and in a case where the set pressure P* is lower than the design pressure Pd and, as shown in FIG. 2 and FIG. 5, the gap between the cross head 28 and the plunger 26 is adjusted such that it is set to the width d, the pressure P1 of the pump chamber 25 of the first pump 20 becomes an approximately equal pressure to the pressure P3 (set pressure P*) of the shared discharge pipe 36 at the end of the preliminary compression step (rotation angle φ of 0°), thereby causing the discharging of fluid without delay from the pump chamber 25 into the shared discharge pipe 36 simultaneously with the start of the discharging step of the first pump 20. Then, the increase in the discharge amount from a rotation angle φ of 0° in the first pump 20 and the decrease in the discharge amount from a rotation angle φ of 0° in the second pump 40 offset each other, thereby causing the total discharge flow rate of the first pump 20 and the second pump 40 to become a constant, rated flow rate without pulsation as shown by the dash-dotted line 91 in FIG. 8A. Furthermore, the pressure P3 of the shared discharge pipe 36 also becomes a constant pressure without pulsation as indicated by the dash-dotted line 96*b* in FIG. 8E.

As described above, if a gap having the width d is provided, the plunger 26 does not advance even when the cross head 28 advances during the preliminary compression step (for example, until a rotation angle φ of −φ0'), and the distance the plunger 26 advances during the preliminary compression step becomes small, that is to say, the effective stroke length of the plunger 26 during the preliminary compression step becomes short, and therefore, the excessive compression of the pump chamber 25 during the preliminary compression step in a case where the set pressure P* is low and the discharge of fluid from the pump chamber 25 during the preliminary compression step can be suppressed, thereby suppressing the generation of pulsation.

In the non-pulsation pump 100 of the present embodiment, in a case where the set pressure P* is high, wherein the amount of volume reduction of the mixed air in the hydraulic chambers 22 and 42 is large, the width of the gap is made small such that the effective stroke length of the plunger 26 is lengthened, and in a case where the set pressure P* is low, wherein the amount of volume reduction of the mixed air is small, the width of the gap is made large such that the effective stroke length of the plunger 26 is shortened, and in either case, the generation of pulsation can be suppressed by adjusting the width of the gap such that the discharging of fluid is started at the end of the preliminary compression step, at which the rotation angle φ is 0°, exactly as the pressure P1 of the pump chamber 25 reaches the set pressure P*.

Furthermore, by designing the amount of movement of the plungers 26 and 46 to be somewhat larger during the preliminary compression step, and increasing the adjustment range of the axial direction position of the stopper 82 to increase the adjustable range of the width of the gap, pulsation can be suppressed across a wider range of set pressures P*.

Furthermore, in the non-pulsation pump 100 of the present embodiment, because the width of the gap can be adjusted by rotating the body 81 of the stroke adjustment mechanism 80, adjustment of the width of the gap can be adjusted not only in a case where the non-pulsation pump 100 is stopped, but also while the non-pulsation pump 100 is in operation. Consequently, adjustment of the width of the gap can be performed such that pulsation is minimized while the non-pulsation pump 100 is in operation.

In the embodiment described above, although the stroke adjustment mechanism 80 that adjusts the effective stroke length of the plunger 26 during the preliminary compression step was described assuming that it is disposed between the cross head 28 and the plunger 26, it is in no way limited to this and, for example, configurations are possible in which the same function is provided between the rotating cam 15 and the cross head 28, at the midpoint of the plunger 26, or the like. Furthermore, although the present embodiment was described using the coil spring 84 as the biasing member, it is in no way limited to this provided it is a member that is able to apply a biasing force and, for example, a ring of an elastic body such as rubber or resin may be used, or a combination of leaf springs may be used. Further, in a case where the impact sound between the reinforcing member 83 of the cross head 28 and the rear end surface 26*d* of the plunger 26 is large, a damper mechanism or a cushioning material may be disposed in between.

Furthermore, in the embodiment described above, although the description assumed that the bottom surface 28*b* of the bottomed hole 28*a* has a reinforcing member 83 attached facing the rear end surface 26*d* of the plunger 26, and the coil spring 84 representing a biasing member is attached between an outer surface of the reinforcing member 83 and an inner surface of the bottomed hole 28*a*, it is not necessary to provide the reinforcing member 83 in a case where the bottom surface 28*b* of the bottomed hole 28*a* is able to sufficiently endure the contact pressure of the rear end surface 26*d* of the plunger 26. Furthermore, the coil spring 84 may be provided in a case where there is a high suction pressure, and a gap having the width d cannot be formed because the pressing force of the plunger 26 due to the suction pressure is greater than the seal sliding resistance, or a case where the cross head 28 and the rear end surface 26*d* of the plunger 26 require a buffer material that relieves the contact pressure, and may also be omitted in a case where the suction pressure is low. Further, an elastic member may be used instead of the coil spring 84.

In the embodiment described above, although the description assumed that the speed of the plungers 26 and 46 becomes zero at a rotation angle φ of 0° and 180° at which the preliminary compression step ends, because the present invention is also applicable in cases where the speed of the plungers 26 and 46 does not become zero when the preliminary compression step ends, the speed of the plungers 26 and 46 does not need to be set to zero at a rotation angle φ of 0° and 180° when the preliminary compression step ends.

REFERENCE SIGNS LIST

10: Frame
11: Motor
12, 13: Shaft
15: Rotating cam
16: Cam mechanism
20, 40: Pump
22, 42: Hydraulic chamber
23, 43: Diaphragm
25, 45: Pump chamber
26, 46: Plunger
26*a*: Step portion
26*b*: Front surface
26*c*: Rear surface
26*d*: Rear end surface
26*e*: Through portion
26*f*: Rear end surface
26*g*: Rear end
27: Seal
28, 48: Cross head
28*a*: Bottomed hole
28*b*: Bottom surface
29, 49: Roller
30, 50: Suction pipe
31, 33, 51, 53: Check valve
32, 52: Discharge pipe
35: Shared suction pipe
36: Shared discharge pipe
63: Pressure sensor
70: Control unit
71: CPU
72: Memory
73: Interface
80: Stroke adjustment mechanism (position adjustment mechanism)
81: Body
81*a*: Guide
81*b*: Cylindrical surface
81*c*: Flange
82: Stopper
82*a*: Annular portion
82*b*: Arm
82*c*: Slider
83: Reinforcing member
83*a*: Front end surface
84: Coil spring
85: Support ring
85*a*: Cylindrical surface
86, 87: Bolt

The invention claimed is:

1. A non-pulsation pump comprising:

a cam mechanism that converts a rotational motion of a shared motor into a reciprocal motion having a prescribed phase difference;

a plurality of cross heads that make a reciprocal motion with a prescribed phase difference through the cam mechanism; and a plurality of reciprocating pumps that are driven with the prescribed phase difference and that include plungers connected to the cross heads, wherein a total discharge flow rate into a shared discharge pipe is kept constant, and the non-pulsation pump includes a preliminary compression step for moving the plungers of the reciprocating pumps to a discharge side by an amount after a suction step but before a discharging step, and the non-pulsation pump further includes a stroke adjustment mechanism, the stroke adjustment mechanism comprising a body and a stopper, the stopper sliding in a front-rear direction with respect to the body, the stopper attached to the cross head in a manner whereby an axial direction position of the stopper with respect to the cross head changes, wherein a gap between a respective cross head of the plurality of cross heads and a respective plunger of the plurality of plungers in the axial direction is configured to be changed by adjusting the axial direction position of the stopper by rotating the body, the stroke adjustment mechanism thereby configured to adjust an effective stroke length of the plunger in the preliminary compression step.

2. The non-pulsation pump according to claim 1, wherein the cross head has a bottomed hole formed in a front end portion into which a step portion of a rear end of the plunger is inserted, the stopper has an annular portion that is screwed into a thread portion formed on an inner peripheral surface of the bottomed hole, and a leading end of the annular portion comes into contact with a front surface of the step portion of the plunger.

* * * * *